US007309252B2

(12) United States Patent
Fabian et al.

(10) Patent No.: US 7,309,252 B2
(45) Date of Patent: Dec. 18, 2007

(54) LOW PROFILE SURFACE MOUNT CONNECTOR

(75) Inventors: David James Fabian, Mount Joy, PA (US); Lawrence John Brekosky, Dillsburg, PA (US); Timothy Lee Kocher, Camp Hill, PA (US); William Gary Lenker, Marysville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/063,065

(22) Filed: Feb. 22, 2005

(65) Prior Publication Data

US 2006/0189174 A1 Aug. 24, 2006

(51) Int. Cl.
*H01R 11/20* (2006.01)

(52) U.S. Cl. ..... 439/404

(58) Field of Classification Search ..... 439/404, 439/853, 381, 405, 402, 83, 395
See application file for complete search history.

(56) References Cited

U.S. PATENT DOCUMENTS

| | | | | | |
|---|---|---|---|---|---|
| 4,223,971 | A | | 9/1980 | Dola et al. | 339/95 D |
| 4,391,484 | A | * | 7/1983 | Foederer | 439/404 |
| 4,820,192 | A | * | 4/1989 | Denkmann et al. | 439/404 |
| 4,865,563 | A | | 9/1989 | Ney et al. | 439/404 |
| 4,964,811 | A | * | 10/1990 | Hayes et al. | 439/398 |
| 5,091,826 | A | * | 2/1992 | Arnett et al. | 361/776 |
| 5,478,248 | A | * | 12/1995 | Mitra et al. | 439/74 |
| 5,547,391 | A | * | 8/1996 | Benes et al. | 439/399 |
| 5,713,767 | A | * | 2/1998 | Hanson et al. | 439/853 |
| 5,877,673 | A | | 3/1999 | Kotani et al. | |
| 5,890,924 | A | * | 4/1999 | Endo et al. | 439/417 |
| 6,050,845 | A | | 4/2000 | Smalley, Jr. et al. | |
| 6,080,006 | A | * | 6/2000 | Broder | 439/409 |
| 6,093,053 | A | | 7/2000 | Horioka et al. | |
| 6,210,204 | B1 | * | 4/2001 | Ko et al. | 439/404 |
| 6,741,453 | B1 | | 5/2004 | Aleardi et al. | |
| 6,755,678 | B2 | * | 6/2004 | Ward et al. | 439/402 |
| 2002/0055295 | A1 | * | 5/2002 | Itai et al. | 439/402 |
| 2004/0253974 | A1 | | 12/2004 | Kao et al. | |

FOREIGN PATENT DOCUMENTS

| | | |
|---|---|---|
| EP | 0413156 | 2/1991 |
| EP | 0489549 | 1/1996 |

OTHER PUBLICATIONS

PCT Search Report for counterpart case, PCT/US2006/006005.

* cited by examiner

*Primary Examiner*—Chandrika Prasad

(57) ABSTRACT

A low profile connector assembly comprises at least one contact having a surface mount portion and a wire engagement portion extending from the surface mount portion, and a housing insertable over the at least one contact and retained to the at least one contact. The housing encloses the wire engagement portion and has a wire receiving aperture therethrough. The wire receiving aperture provides access to the wire engagement portion when the housing is retained to the contact.

19 Claims, 6 Drawing Sheets

LOW PROFILE SURFACE MOUNT CONNECTOR

BACKGROUND OF THE INVENTION

This invention relates generally to electrical connectors, and, more particularly, to low profile connectors for mounting to substrates and connecting wires thereto.

Recent advances in illumination technology have resulted in the prolific use of distributed lighting assemblies in many applications. Distributed lighting assemblies are desirable, for example, for interior and exterior illumination of a vehicle, for decorative, accent, and safety lighting in business, homes, and outdoor illumination of sidewalks, swimming pools, steps, and even for directional and advertisement signage.

Conventional distributed light assemblies include a high intensity light source and a plurality of light transmission conduits (e.g., fiber optic cables, light pipes, and the like) for illuminating locations remote from the light source. A plurality of light sources (e.g., incandescent bulbs, halogen lamps, and the like) have been employed with an equal plurality of light transmission members to produce distributed lighting effects. It is difficult, however, to produce even lighting from the multiple light sources, and the assemblies are not as reliable as desired. Tubular light sources (e.g., neon, fluorescent, and the like) have been utilized to produce more even lighting, but are notably disadvantaged as requiring high voltage power supply converters to operate the tubes. Additionally, tubular light sources have poor impact resistance, rendering them unsuitable for many applications.

Recent technological advances in low voltage light sources, such as light emitting diodes (LEDs), now present low voltage light sources as viable candidates as light sources for distributed lighting assemblies. Low voltage light sources operate at a small fraction of the electrical power of conventionally used light sources and are an attractive option for use in distributed lighting assemblies due to generally lower cost and higher efficiency than conventionally used light sources. Thus far, however, obtaining a reliable and even light output from low voltage light sources in a distributed lighting assembly has proven difficult.

In certain applications, low voltage light devices including LEDs are connected to an aluminum substrate in use, and connecting wires from the low voltage light devices are hand soldered to the substrate. It would be desirable to provide a lower cost and more time efficient manner of connecting the low voltage lighting devices to the substrates. Known connectors, however, are disadvantaged for purposes.

For example, known connectors are typically too large to be effectively used with low voltage lighting devices such as LED packages, because when mounted to the substrate the relative sizes of the connectors and the LED packages can lead to shadows and a non-uniform light emission from the LEDs. Additionally, mounting the connectors to the substrate and retaining the connector to the substrate can itself become problematic due to the low profile of the LED packages.

BRIEF DESCRIPTION OF THE INVENTION

According to an exemplary embodiment, a low profile connector assembly comprises at least one contact having a surface mount portion and a wire engagement portion extending from the surface mount portion, and a housing insertable over the at least one contact and retained to the at least one contact. The housing encloses the wire engagement portion and has a wire receiving aperture therethrough. The wire receiving aperture provides access to the wire engagement portion when the housing is retained to the contact.

Optionally, the housing and contact define a low profile dimension of approximately 10 mm or less measured substantially perpendicular to a substrate to which the surface mount portion is mounted. The wire engagement portion may include an insulation displacement contact section, a plurality of deflectable fingers configured to engage a wire, a contact beam pivoting in a plane parallel to the surface mount portion when a wire is engaged thereto, or a box clamp contact. The wire engagement portion may be configured for two stage engagement with the housing. A plurality of contacts may be provided, and the contacts may be staggered or offset from one another on opposite sides of the housing.

According to another exemplary embodiment, a low profile connector assembly for mounting to a substrate is provided. The connector assembly comprises a housing, first and second contacts each having a surface mount portion and a wire engagement portion extending from the surface mount portion, and a housing insertable over the first and second contacts and retained to the at least one contact. The housing encloses the wire engagement portion and has a first wire receiving aperture and a second wire receiving aperture each configured to receive respective wires. The wire engagement portions of the first and second contacts are configured to engage and retain the wires, wherein the first and second contacts define a low profile dimension of about 10 mm or less measured perpendicularly to the substrate on which the surface mount portions are to be mounted.

According to another exemplary embodiment, a low profile connector assembly for mounting to a substrate is provided. The connector assembly comprises a housing, and first and second contacts each having a surface mount portion and a wire engagement portion extending from the surface mount portion. Each wire engagement portion comprises a deflectable contact beam extending obliquely to a distal end of the surface mount portion. A housing is insertable over the first and second contacts and is retained to the first and second contacts. The housing encloses the contact beams and has a first wire receiving aperture and a second wire receiving aperture configured to receive respective wires. The contact beams deflect and clamp the wires within the housing.

DETAILED DESCRIPTION OF THE INVENTION

While various embodiments low profile connectors are described below in an exemplary application of interfacing low voltage lighting devices, such as light emitting diode (LED) packages, it is understood that the low profile connector of the present invention may be beneficial in other applications as well. Low voltage lighting applications are but one potential application of the present invention, and the invention is not intended to be limited to any particular end use or application. The following embodiments are therefore provided for illustrative purposes only.

Figure 1:
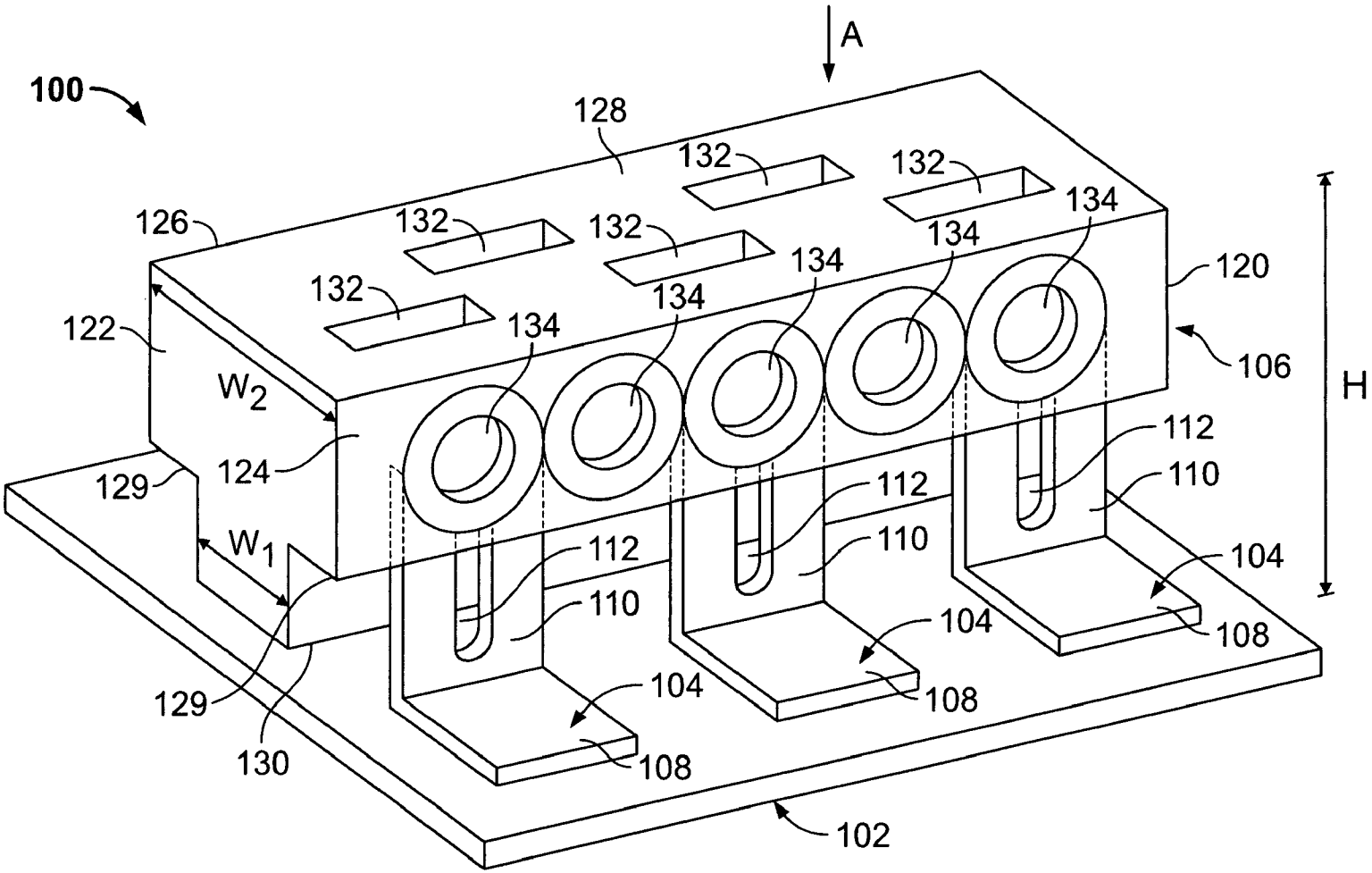
FIG. 1 is a perspective view of a first exemplary embodiment of a low profile connector assembly formed in accordance with the present invention.

FIG. 1 is a perspective view of a first exemplary embodiment of a low profile connector assembly 100 formed in accordance with the present invention. The connector assembly 100 includes a substrate 102, contacts 104 mounted to the substrate 102, and a housing 106 inserted over the contacts 104 and retained thereto.

The substrate 102 is generally flat and planar, and in one embodiment is fabricated from aluminum or another substrate material familiar to those in the art. The contacts 104 are fabricated from a conductive material and in an illustrative embodiment include generally flat and planer surface mount portions 108 in an abutting relationship with the substrate 102, and wire engagement portions 110 extending generally perpendicularly from the surface mount portions 108. The wire engagement portions 110 in one embodiment are insulation displacement contact sections having a wire receiving channel 112 and upper edges (not shown in FIG. 1) configured to pierce outer insulation of a connecting wire (not shown in FIG. 1) in a manner known in the art. The insulation displacement sections of the contacts 104 allow connection to connecting wires of, for example, low voltage lighting devices and LED packages, without stripping the connecting wires of insulation and without hand soldered connections, and thus result in time and cost savings for installing the connector assembly 100. The connector assembly 100 has an assembled configuration and a terminated configuration (achieved by downward insertion of the housing 106 in the direction of arrow A.

The housing 106 has T-shaped end walls 120, 122, front and rear sides 124 and 126, and top and bottom surfaces 128 and 130. The end walls 120, 122 have a first width $W_1$ near the bottom surface 130 and a second width $W_2$ near the top surface 128 that is greater than the width $W_1$. Due to the difference in widths $W_1$ and $W_2$, overhanging ledges 129 are formed in the housing 106 between the top and bottom surface 128 and 130.

Contact cavities 132 are formed in the housing 106 and extend from the top surface 128 to the underside of the overhanging ledges 129 opposite the top surface 128. The contact cavities 132 receive the wire engagement portions 110 of the respective contacts 104 when the housing 106 is inserted downwardly over the contacts 104 in the direction of arrow A. The wire engagement portions 110 of the contacts 104 are retained to the housing 106 with an interference fit, or by other locking and latching arrangements known in the art.

The contacts 104 in the illustrated embodiment are arranged in first and second rows corresponding the housing cavities 132, and accordingly the housing 106 includes three contact cavities 132 arranged in a row along the housing front side 124, and two contact cavities arranged in a row along the housing rear side 126. The contact cavities 132 along the rear side 126 are staggered or offset in relation to the contact cavities 132 extending along the front side 124. As such, the housing 106 may accommodate five contacts 104 oriented in opposite directions along the housing front and rear sides 124 and 126. Greater or fewer contact cavities 132 and associated contacts may be provided in similar or different arrangements in alternative embodiments.

The housing 106 further includes wire receiving apertures 134 in communication with the housing contact cavities 132 such that a connecting wire may be inserted through the wire receiving apertures 134 and into the contact cavities 132. Once the wires are inserted in into the contact cavities 132, the housing 106 may be fitted downwardly onto the contacts 104 from above. As the housing 106 is moved downward in the direction of arrow A, the wire engagement portions 110 of the contacts 104 are received in the contact cavities 132 through the overhanging ledges 129, and the wires are brought into mechanical and electrical engagement with the wire engagement portions 110 of the contacts 104. Because the wire engagement portions 110 include insulation displacement sections, the insulation displacement sections penetrate the wire insulation and the wire conductors are received in the wire channels 112.

The connector 100, in the assembled configuration, may be surface mounted to the substrate 102 using known surface mount soldering techniques. Wires are inserted into the apertures 134 and terminated to the contacts 104 by being pressed downward in the direction of arrow A to a terminated configuration. The wires, therefore, need not be individually terminated to the substrate 102, hut rater may be collectively and simultaneously engaged to the contacts 104 by virtue of the housing 106. The wires need not be stripped of insulation, and tools are not necessary to connect the wires, thereby simplifying installation and reducing installation time and cost.

Further, because the wire engagement portions 110 of the contacts 104 extend upwardly in an L-shape configuration from the contact surface mount portions 108, the connector assembly has a particularly low profile and is amenable for use with low voltage light sources, such as LED packages in distributed lighting assemblies. For example, the connector assembly 100 may extend for a total low profile dimension H, measured generally perpendicular from the top surface of the substrate 102 to the top surface 128 of the housing 106, of about 10 mm or less, and thus, unlike known connectors, the connector assembly 100 may be used with low voltage lighting devices on the substrate 102 without creating shadows in the emitted light from the devices. In a particular embodiment, H is approximately 6.35 mm when the housing 106 is fully installed over the contacts 104, although greater or lesser low profile dimensions H may be employed in other embodiments.

Additionally, the staggered contacts 104 and housing contact cavities 132 provides a compact, space saving configuration providing multiple connections in comparison to other known connectors.

Figure 2:
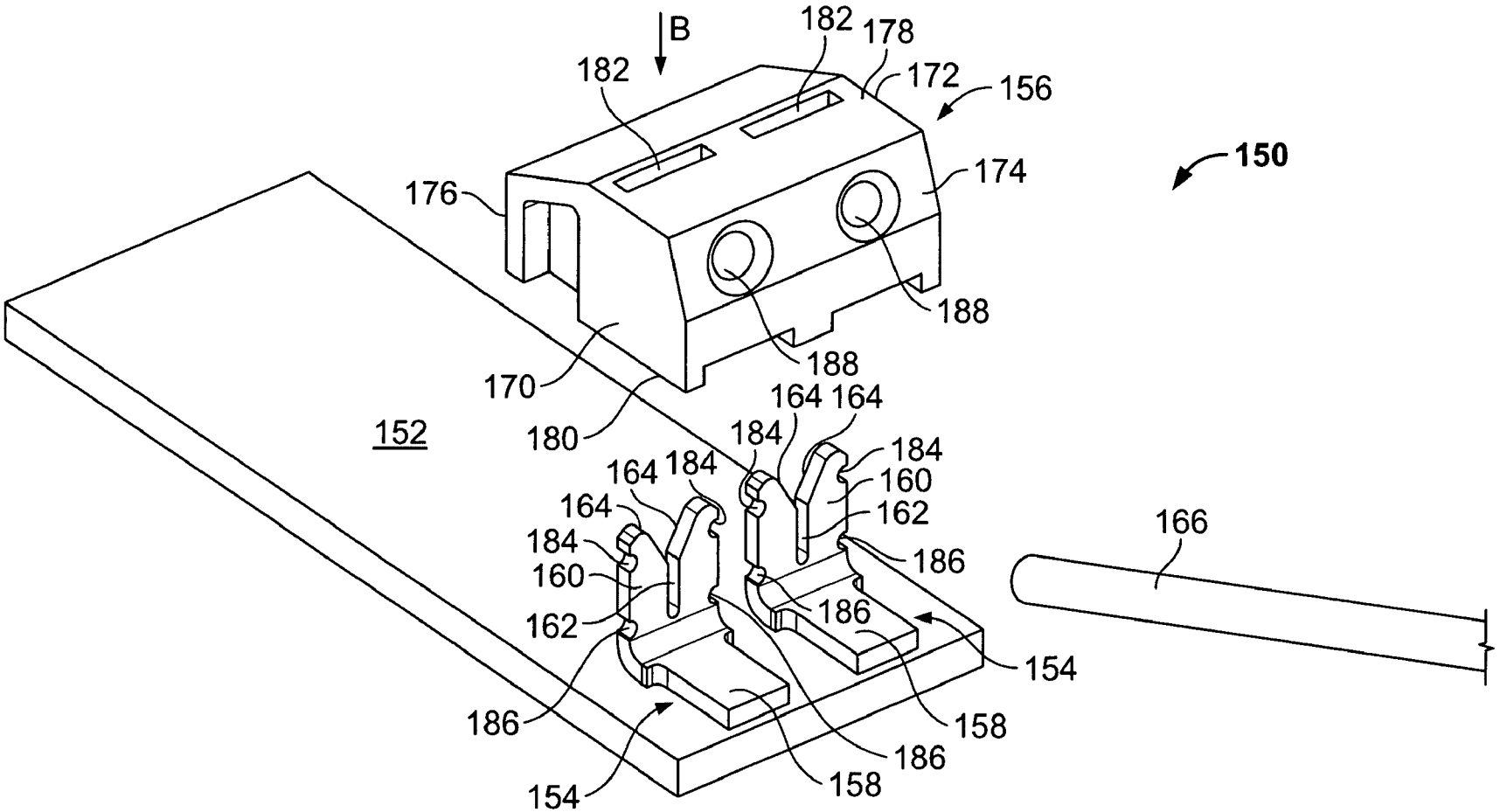
FIG. 2 is an exploded view of a second exemplary embodiment of a low profile connector assembly formed in accordance with the present invention.

FIG. 2 is an exploded view of a second exemplary embodiment of a low profile connector assembly 150 formed in accordance with the present invention.

The connector assembly 150 includes a substrate 152, contacts 154 mounted to the substrate 152, and a housing 156 inserted over the contacts 154 and retained thereto.

The substrate 152 is generally flat and planar, and in one embodiment is fabricated from aluminum or another substrate material familiar to those in the art. The contacts 154 are fabricated from a conductive material and in an illustrative embodiment include generally flat and planer surface mount portions 158 in an abutting relationship with the substrate 152, and wire engagement portions 160 extending generally perpendicularly from the surface mount portions 158. The wire engagement portions 160 in one embodiment are insulation displacement contact sections having a wire receiving channel 162 and upper edges 164 configured to pierce outer insulation of a wire 166 in a manner known in the art. The insulation displacement sections of the contacts 154 allow connection to connecting wires 166 of, for example, low voltage lighting devices, without stripping the wire of insulation, and thus result in time and cost savings for installing the connector assembly 150.

The housing 156 has end walls 170, 172, front and rear sides 174 and 176, and top and bottom surfaces 178 and 180. Contact cavities 182 are formed in the housing 156 and extend from the top surface 178 through the bottom surface 180. The contact cavities 182 receive the wire engagement portions 160 of the respective contacts 154 when the housing 156 is inserted downward over the contacts 154 in the direction of arrow B. The wire engagement portions 160 of the contacts 154 include an upper pair of notches 184 and a lower pair of notches 186 which cooperate with retaining features or projections in the housing cavities 182 to retain the housing 156 to the contacts 154. More specifically, the upper notches 186 receive the housing retaining features at a first elevation relative to the substrate 152, and the lower notches 186 receive the housing retaining features at a second elevation relative to the substrate 152 that is lower and closer to the substrate than the first elevation. When the housing is engaged to the upper notches 186, wires 166 may be inserted into the housing 156, and the housing may then be moved to downward in the direction of arrow B to engage the housing 156 to the lower notches 186, wherein the wires are fully engaged to the contacts 154.

The housing 156 includes wire receiving apertures 188 in communication with the housing contact cavities 182 such that a wire 166 may be inserted through the wire receiving apertures 188 and into the contact cavities 182. Once the wires 166 are inserted into the contact cavities 182, the housing 156 may be fitted downwardly onto the contacts 154 from above to enclose and protect the contacts 154. As the housing 156 is moved downward in the direction of arrow B toward the contacts 154, the wire engagement portions 160 of the contacts 154 are received in the contact cavities 182 and the wires are brought into mechanical and electrical engagement with the wire engagement portions 160 of the contacts 160. Because the wire engagement portions 154 include insulation displacement sections, the insulation displacement sections penetrate the wire insulation and the wire conductors are received in the wire channels 162.

The connector 150, in a pre-assembled state wherein the housing 156 is engaged to the upper notches 184 of the contacts 154, may be surface mounted to the substrate 152 using known surface mount soldering techniques. The wires 166 are then inserted into the housing 156 through the apertures 188 and into the contact cavities 182. Once the wires 166 are inserted, the housing 156 may be moved downwardly to engage the lower notches 186 of the contacts 154. Because of the insulation displacement sections of the contact wire engagement portions 160, the wires 166 need not be individually terminated to the substrate 102, but rather may be collectively and simultaneously engaged to the contacts 104 by virtue of the downward movement of the housing 106. The wires 166 need not be stripped of insulation, and tools are not necessary to connect the wires, thereby simplifying installation and reducing installation time and cost.

Further, because the wire engagement portions 160 of the contacts 154 extend upwardly in an L-shape configuration from the contact surface mount portions 158, the connector assembly 150 has a particularly low profile and is amenable for use with low voltage light sources, such as LED packages in distributed lighting assemblies. For example, the connector assembly 150 may extend for a total low profile dimension, measured generally perpendicularly from the top surface of the board to the top surface 178 of the housing 156, of about 10 mm or less, although greater or lesser low profile dimensions H may be employed in other embodiments. Unlike known connectors, the connector assembly 150 may therefore be used with low voltage lighting devices on the substrate 102 without creating shadows in the emitted light from the devices.

Figure 3:
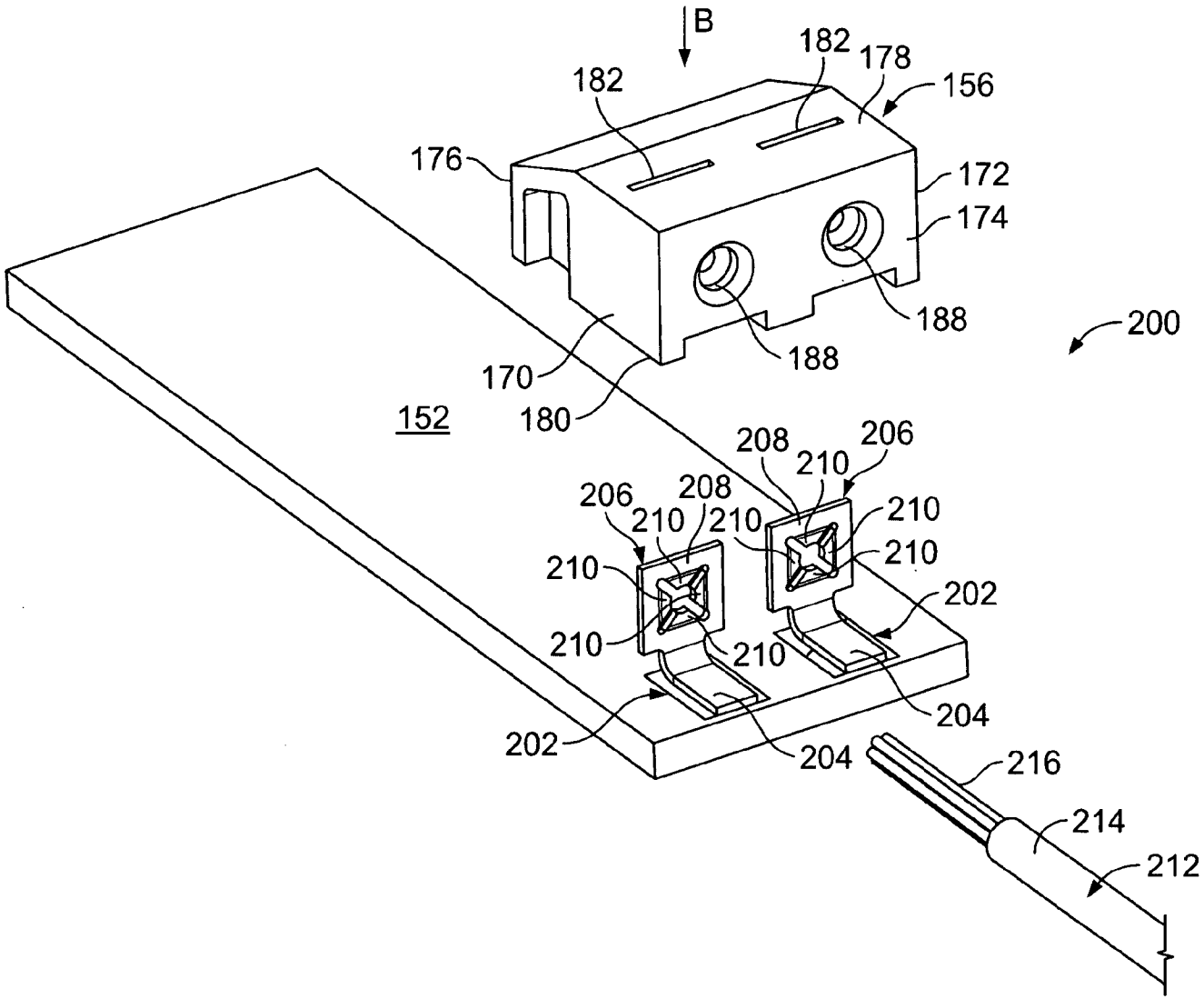
FIG. 3 is an exploded view of a third exemplary embodiment of a low profile connector assembly formed in accordance with the present invention.

FIG. 3 is an exploded view of a third exemplary embodiment of a low profile connector assembly 200 formed in accordance with the present invention. The connector assembly 200 is similar is some aspects to the connector assembly 150 (shown in FIG. 2). Like elements of the connector assembly 200 and the connector assembly 150 are therefore indicated with like reference characters in FIG. 3.

The connector assembly 200 includes the substrate 152, contacts 202 mounted to the substrate 152, and a housing 156 inserted over the contacts 202 and retained thereto.

The contacts 202 are fabricated from a conductive material and in an illustrative embodiment include generally flat and planer surface mount portions 204 in an abutting relationship with the substrate 152, and wire engagement portions 206 extending generally perpendicularly from the surface mount portions 204. The wire engagement portions 206 in one embodiment are poke-in wire engagement sections having a generally rectangular frame 208 and deflectable contact fingers 210 extending inwardly from the frame 208 to define a four sided web extending from the inner periphery of the frame 208. When a wire 212 is stripped of insulation 214 on one end thereof to expose inner conductors 216 of the wire, the conductors 216 are received through the inner web of the contact frame 208 and the fingers 210 are resiliently deflected around the respective sides of the conductors 216 to mechanically and electrically engage the conductors 216 to contacts 202. The poke-in wire engagement portions 206 allow for termination of the wires 212 to the contacts 202 with relative ease, especially in comparison to hand soldered termination of the wires 212 which is common to known distributed lighting assemblies.

While the contacts 202 in the illustrated embodiment include four deflectable fingers 210 defining a contact web, it is understood that other numbers of contact fingers (e.g., two contact fingers) may likewise be employed in alternative embodiments while still achieving the benefits of the instant invention.

The housing 156 has end walls 170, 172, front and rear sides 174 and 176, and top and bottom surfaces 178 and 180. Contact cavities 182 are formed in the housing 156 and extend from the top surface 178 through the bottom surface 180. The contact cavities 182 receive the wire engagement portions 206 of the respective contacts 202 when the housing 156 is inserted downward over the contacts 202 in the direction of arrow B. The wire engagement portions 206 of the contacts 202 are retained to the housing 156 with an interference fit in the contact cavities 182, although it is appreciated that other retention features may be employed that are known in the art to retain the contacts 202 to the housing 156.

The housing 156 includes wire receiving apertures 188 in communication with the housing contact cavities 182 such that a wire 212 may be inserted through the wire receiving apertures 188 and into the contact cavities 182. Once the housing 156 is retained to the contacts 202, wires 212 may be inserted tough the housing apertures 188 to engage the wire receiving portions 206 of the contacts 202. Because of the poke-in wire engagement portions 206 of the contacts 202, the wires 212 may be reliably connected to the contacts with reduced installation time and cost.

Further, because the wire engagement portions 206 of the contacts 202 extend upwardly in an L-shape configuration from the contact surface mount portions 204, the connector assembly 200 has a particularly low profile and is amenable for use with low voltage light sources, such as LED packages in distributed lighting assemblies. For example, the connector assembly 200 may extend for a total low profile dimension, measured generally perpendicularly from the top surface of the substrate 152 to the top surface 178 of the housing 156, of about 10 mm or less, although greater or lesser low profile dimensions may be employed in other embodiments. Unlike known connectors, the connector assembly 200 may therefore be used with low voltage lighting devices on the substrate 152 without creating shadows in the emitted light from the devices.

Figure 4:
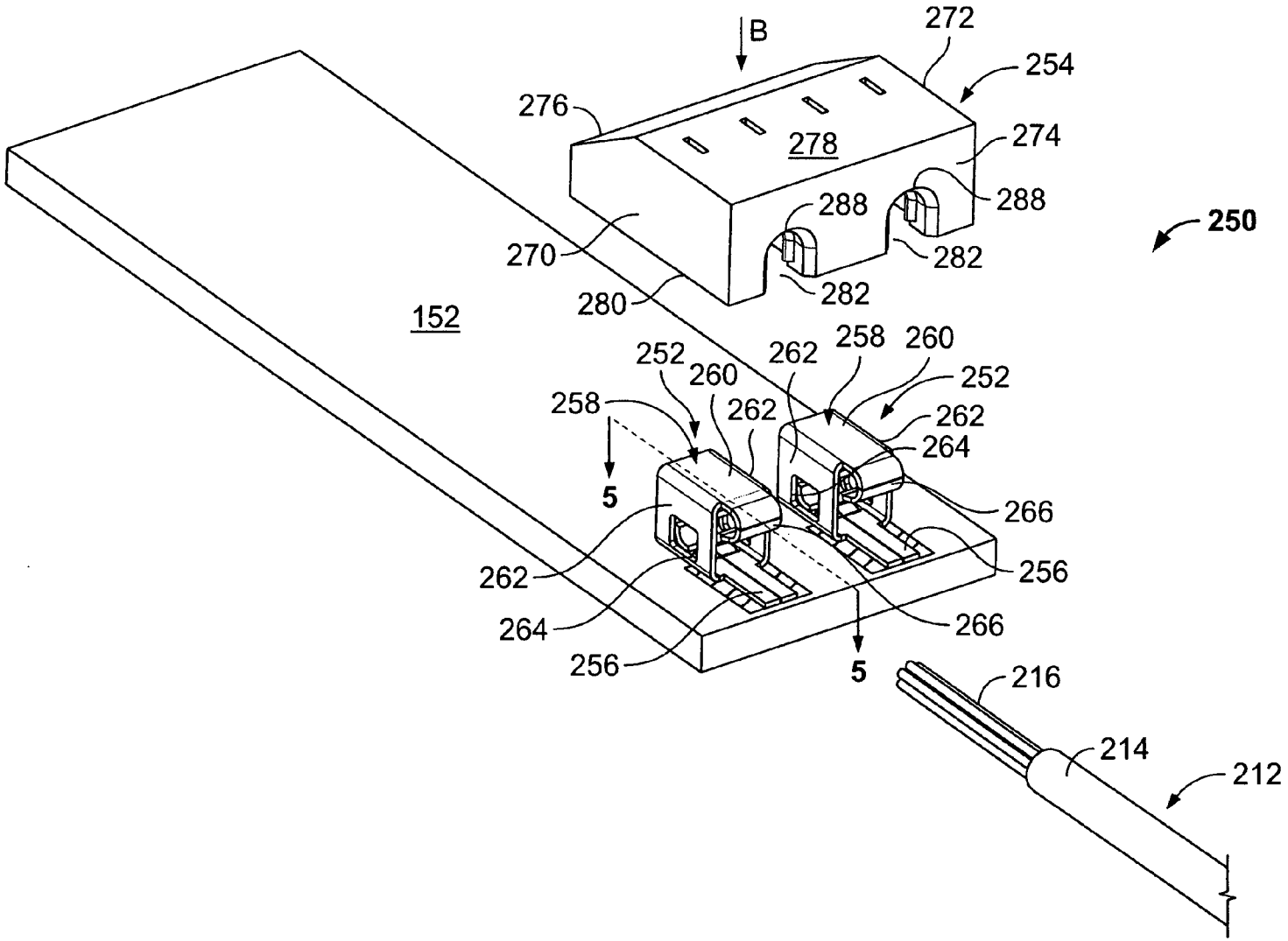
FIG. 4 is an exploded view of a fourth exemplary embodiment of a low profile connector assembly formed in accordance with the present invention.

FIG. 4 is an exploded view of a fourth exemplary embodiment of a low profile connector assembly 250 formed in accordance with the present invention.

The connector assembly 250 includes the substrate 152, contacts 252 mounted to the substrate 152, and a housing 254 inserted over the contacts 252 and retained thereto.

The contacts 252 are fabricated from a conductive material and in an illustrative embodiment include generally flat and planer surface mount portions 256 in an abutting relationship with the substrate 152, and wire engagement portions 258 extending generally perpendicularly from the surface mount portions 256. The wire engagement portions 258 in one embodiment are box clamp contact sections having a top wall 260 and opposite side walls 262 extending from the top wall 260 in a rectangular configuration. The side walls 260 and 262 include cutout portions or windows 264 therein which cooperate with latching features on the housing 254 to retain the housing 254 to the contacts 252. The top wall 260 of the box clamp wire engaging portions 258 includes a deflectable contact beam 266 which clamps to conductors 216 of a wire 212 in the manner explained below.

The housing 254 has end walls 270, 272, front and rear sides 274 and 276, and top and bottom surfaces 278 and 280. Contact cavities 282 are formed in the housing 254 and extend from the top surface 278 through the bottom surface 280. The contact cavities 282 receive the wire engagement portions 258 of the respective contacts 252 when the housing 254 is inserted downward over the contacts 252 in the direction of arrow B and the housing 254 is latched to the retention windows 264 of the contacts 252. The housing 254 also includes wire receiving apertures 288 in communication with the housing contact cavities 282 such that a wire 212 may be inserted through the wire receiving apertures 288, into the contact cavities 282, and engaged to the wire engagement portions 258 of the contacts 252.

Figure 5:
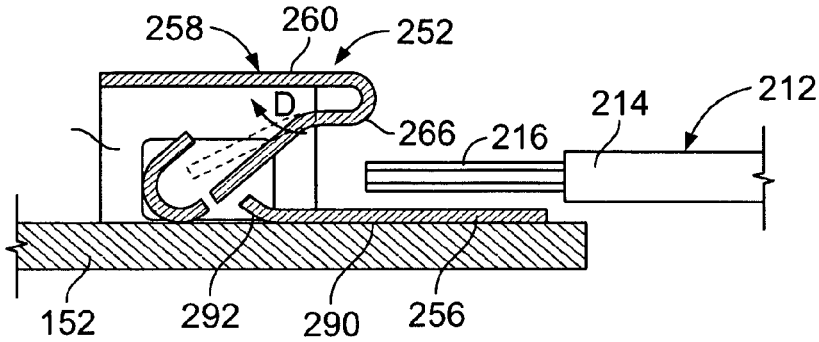
FIG. 5 is a sectional view of a portion of FIG. 4 along line 5-5.

FIG. 5 is a sectional view of one of the contacts 252 surface mounted to the substrate 152, and illustrating the box clamp connection of one of the wires 212 to the wire engaging portion 258. As seen in FIG. 5, the top wall 260 of the wire engaging portion 258 includes the deflectable contact beam 266 extending obliquely from the top wall 260 into the path of the wire 212 when inserted between the side walls 262 of the box clamp section. The beam 266 is deflectable in the direction of arrow D away from the wire 212 and toward the top wall 260 when contacted by the conductors 216 of the wire 212 to a loading position indicated in phantom in FIG. 5. A bottom wall 290 of the box clamp section includes a guide ramp 292 to guide the conductors 216 of the wire 212 into the beam 266 and toward the loading position. When the wire conductors 216 are sufficiently inserted between the contact side walls 262, the contact beam returns 266 toward its original position, thereby clamping the wire conductors 216 between the contact beam 266 and the guide ramp 292 of the contact bottom wall 290.

Because of the box clamp wire engagement portions 258 of the contacts 252, the wires 212 may be reliably connected to the contacts with reduced installation time and cost. Further, the side walls 262 of the contact wire engagement portions 258 extend upwardly in a substantially perpendicular manner to the contact surface mount portions 256, and the connector assembly 250 has a particularly low profile and is amenable for use with low voltage light sources, such as LED packages in distributed lighting assemblies. For example, the connector assembly 250 may extend for a total low profile dimension, measured generally perpendicular from the top surface of the substrate 152 to the top surface 278 (FIG. 5) of the housing 254 of about 10 mm or less, although greater or lesser low profile dimensions may be employed in other embodiments. Unlike known connectors, the connector assembly 250 may therefore be used with low voltage lighting devices on the substrate 152 without creating shadows in the emitted light from the devices.

Figure 6:
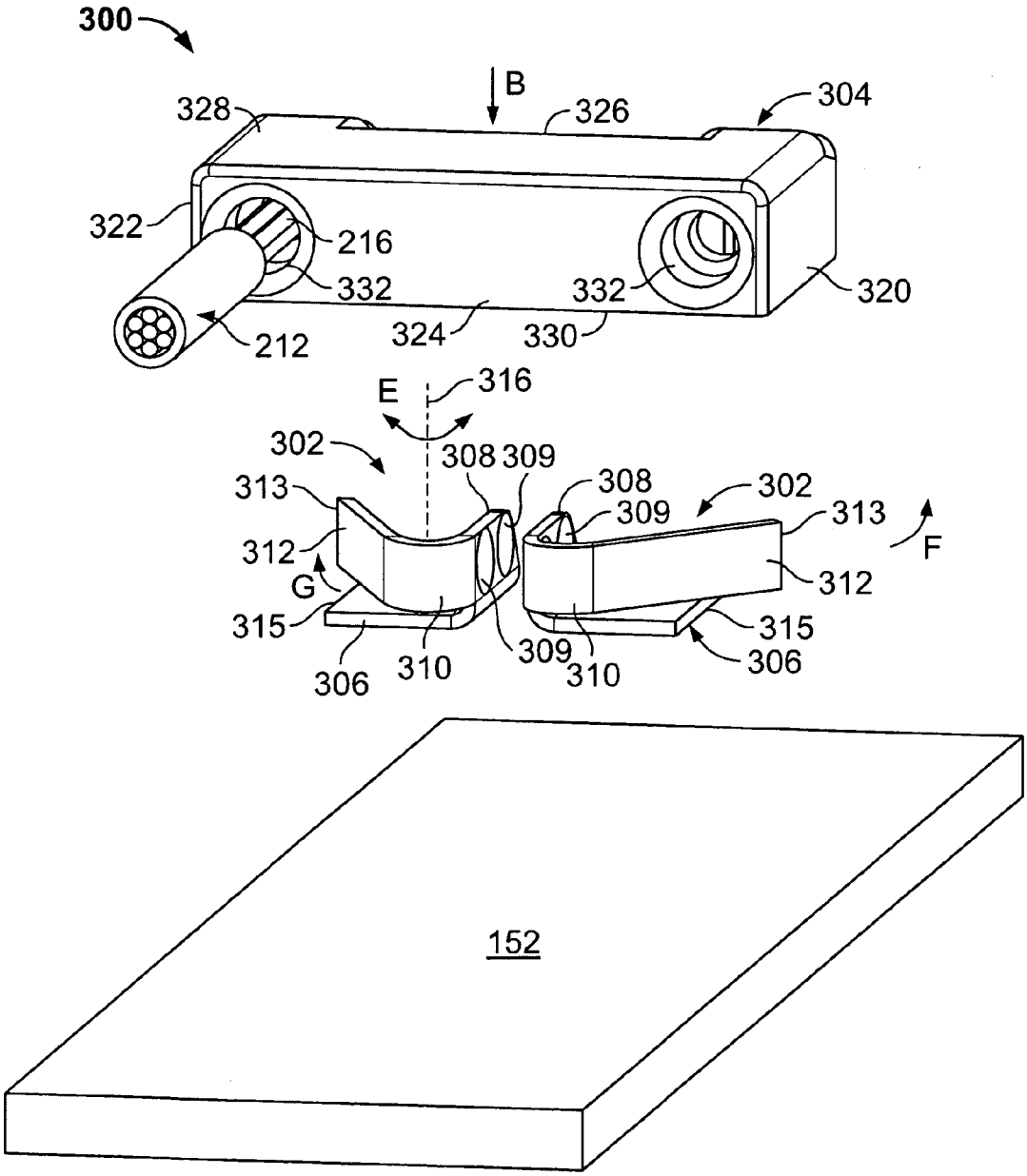
FIG. 6 is an exploded view of a fifth exemplary embodiment of a low profile connector assembly formed in accordance with the present invention.

FIG. 6 is an exploded view of a fifth exemplary embodiment of a low profile connector assembly 300 formed in accordance with the present invention.

The connector assembly 300 includes the substrate 152, contacts 302 mounted to the substrate 152, and a housing 304 inserted over the contacts 302 and retained thereto.

The contacts 302 are fabricated from a conductive material and in an illustrative embodiment each contact 302 includes a generally flat and planer surface mount portion 306 in an abutting relationship with the substrate 152, a housing engagement section 308 extending substantially perpendicular to the surface mount portions 306, and a wire engagement portion 310 extending from the housing engagement section 308.

The contact surface mount portions 306 are generally rectangular in an illustrative embodiment and lie in a common plane tangential to the substrate 152. The housing engagement portion 308 of the contacts 302 are generally flat and planar and extend perpendicularly or in an L-shape configuration from the surface mount portions 306. The housing engagement portions 308 include retaining projections or bumps 309 extending outwardly therefrom. The housing engagement portions 308 of the contacts 302 are received in slots (not shown) in the housing 304 and are retained thereto with an interference fit by virtue of the retaining projections or bumps 309.

The wire engagement portions 310 of each contact 302 includes a deflectable contact beam 312 extending obliquely from the housing engagement section 308 and also extending over and vertically spaced from the surface mount portion 306. The contact beams 312 extend along a longitudinal axis which is parallel to the surface mount portions 306, and also extend obliquely to the edges of the surface mount portion 306. That is, the contact beam 312 of each contact 302 extends at an angle with the each of the side edges of the rectangular surface mount portion 306 so that a distal end 313 of the contact beam 312 extends beyond and overhangs the distal end 315 of the surface mount portions 306 opposite the housing engagement portions 308. In an exemplary embodiment, the contacts 302 are oriented inversely to one another in a mirror image arrangement wit the contact beams 312 extending in opposite directions and away from one another. The contact beams 312 are constructed to pivot, rotate or deflect about a respective vertical axis 316 extending normally or perpendicularly to the surface mount portions 306 when engaged by a wire 212. Stated another way, the contact beams 312 may rotate in the direction of arrow E about the axis 316 such that the longitudinal axis of the contact beams 312 are deflected in a plane parallel to the plane of the surface mount portions 306 when engaged by a wire 212. That is, the distal ends 313 of the contact beams 312 are moved inwardly in the direction of arrows F and G toward the respective engagement portions 308 when engaged by a wire 212, or more particularly the conductors 216 of the wire 212.

The housing 304 has end walls 320, 322, front and rear sides 324 and 326, and top and bottom surfaces 328 and 330. Contact cavities (not shown in FIG. 6) are formed in the housing 304 and extend from the top surface 328 through the bottom surface 330. The contact cavities receive the wire engagement portions 310 of the respective contacts 302 when the housing 304 is inserted downwardly over the contacts 302 in the direction of arrow B. The housing 320 also includes wire receiving apertures 332 in communication with the housing contact cavities such that a connecting wire 212 may be inserted through the wire receiving apertures 332 into the contact cavities and engaged to the wire engagement portions 310 of the contacts 302. The connector 300 may be surface mounted to the substrate 152 using known surface mount soldering techniques.

Figure 7:
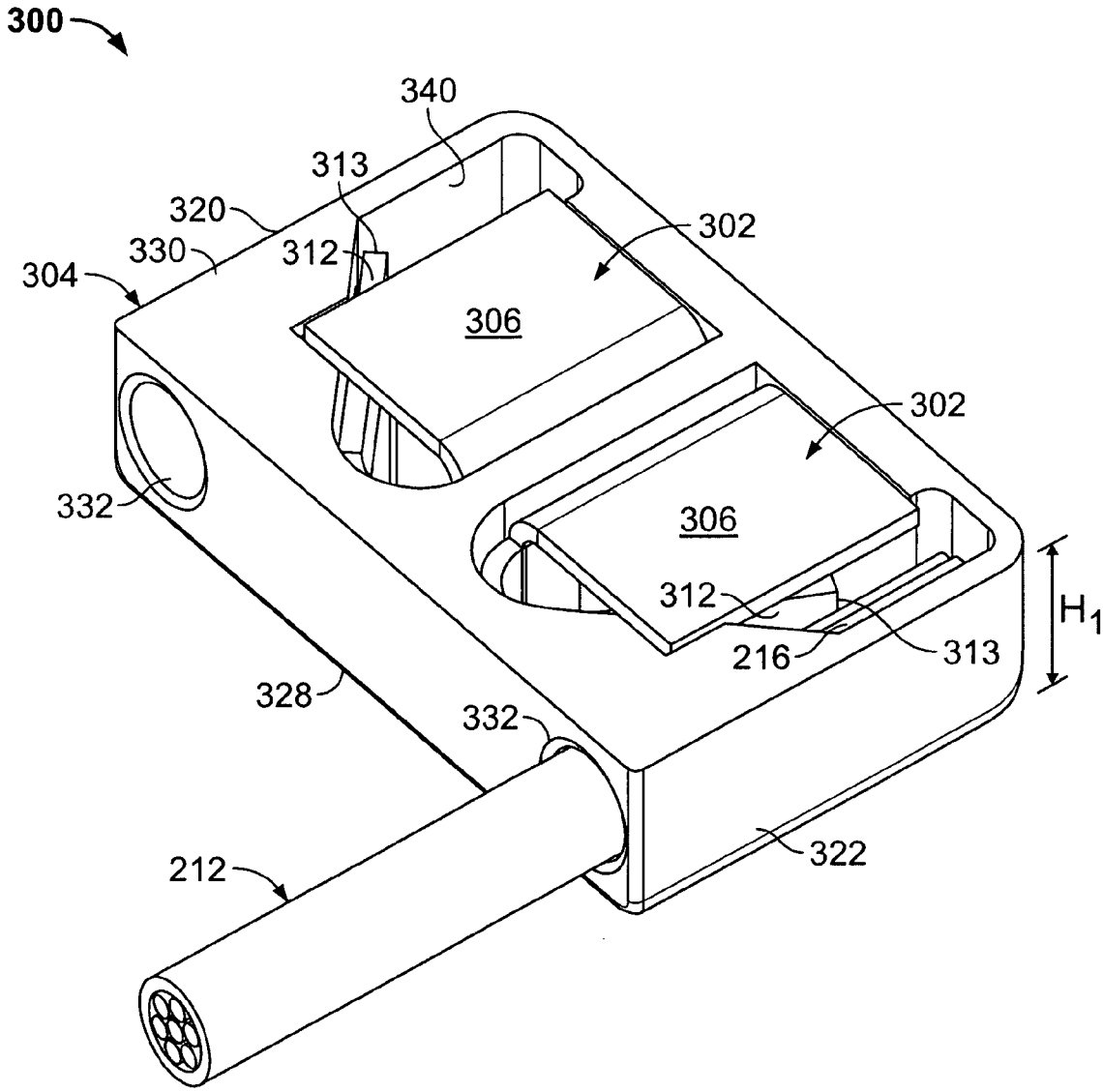
FIG. 7 is an assembled view of the connector assembly shown in FIG. 7.

FIG. 7 is an assembled view of the connector assembly 300 illustrating the contacts 302 secured to the housing 304 via the housing engagement portions 308 (FIG. 6) and located in contact cavities 340 extending through the housing bottom surface 330. The surface mount portions 306 of the contact 302 are exposed through the housing bottom surface 330 for surface mounting to the substrate 152 (FIG. 6), and the contact beams 312 are angled toward the end walls 320 and 322 of the housing 304 such that the distal ends 313 of the contact beams 312 are located adjacent the respective housing end walls 320 and 322. When a connecting wire 212 is passed through the wire receiving apertures 332 of the housing front side 324, the wire conductors 216 deflect the contact beams 312, and the wire conductors 216 we clamped between the distal ends 313 of the contact beams 312 and the housing end walls 320, 322.

The contact beams 312 provide for reliable connection to the contacts 302 with reduced installation time and cost. Further, the oblique contact beams 312 result in a particularly compact profile of the contacts 302 and the housing 304. The connector assembly 300 is therefore amenable for use with low voltage light sources, such as LED packages in distributed lighting assemblies. For example, the connector assembly 300 may extend for a total low profile dimension $H_1$, measured generally perpendicularly from the top surface of the substrate 152 (FIG. 6) to the top surface 328 of the housing 304 of about 10 mm or less, and in a particular embodiment $H_1$ is about 3.28 mm and may therefore accommodate smaller lighting devices in comparison to known connectors. It is appreciated, however, that greater or lesser low profile dimensions $H_1$ may be employed in other embodiments. Unlike known connectors, the connector assembly 300 may therefore be used with low voltage lighting devices on the substrate 152 without creating shadows in the emitted light from the devices.

While the invention has been described in terms of various specific embodiments, those skilled in the art will recognize that the invention can be practiced with modification within the spirit and scope of the claims.

What is claimed is:

1. A low profile connector assembly comprising:

at least one contact having a surface mount portion for surface mounting to a substrate and a wire engagement portion extending from the surface mount portion, said wire engagement portion having a front face, said surface mount portion unitarily formed with said wire engagement portion; and a housing insertable over said at least one contact in a mounting direction parallel to said front face of said wire engagement portion, said housing retained to said at least one contact by an interference fit, said housing enclosing said wire engagement portion and having at least one wire receiving aperture therethrough, said wire receiving aperture being configured to receive a wire therein such that an inner surface of said wire receiving aperture surrounds more than one half of the perimeter of the wire, said wire receiving aperture providing access to said wire engagement portion when said housing is retained to said contact.

2. A low profile connector assembly in accordance with claim 1 wherein said housing and contact define a low profile dimension of approximately 10 mm or less measured substantially perpendicular to a substrate to which said surface mount portion is mounted.

3. A low profile connector assembly in accordance with claim 1 wherein said surface mount portion of said contact is substantially planar, and said wire engagement portion extends substantially perpendicularly to said surface mount portion.

4. A low profile connector assembly in accordance with claim 1 wherein said wire engagement portion includes an insulation displacement contact section.

5. A low profile connector assembly in accordance with claim 1 wherein said wire engagement portion is configured for two stage engagement with said housing.

6. A low profile connector assembly in accordance with claim 1 wherein said at least one contact further includes a housing engagement section extending between said surface mount portion and said wire engagement portion, said housing engagement portion configured to secure said contact to said housing and said housing engagement portion extending substantially perpendicularly to said surface mount portion.

7. A low profile connector assembly in accordance with claim 1, wherein said at least one contact comprises a plurality of contacts, said contacts staggered from one another on opposite sides of said housing.

8. A low profile connector assembly in accordance with claim 1 wherein said wire receiving aperture receives the wire prior to said housing being inserted over said contact such that the wire is configured to engage said contact as said housing is inserted over said contact.

9. A low profile connector assembly in accordance with claim 1 wherein said housing includes a contact cavity, said housing being securely retained to said contact by an interference fit between said contact and walls defining said contact cavity.

10. A low profile connector assembly in accordance with claim 1 wherein said at least one contact comprises multiple contacts, said housing comprising multiple wire receiving apertures such that said housing is adapted to receive multiple wires, said housing being inserted over said multiple contacts such that said contacts simultaneously engage respective ones of the wires.

11. A low profile connector assembly in accordance with claim 1 wherein said housing includes a wire mating face and a contact mating face extending transversely from said wire mating face, said wire receiving aperture accessible through the wire mating face.

12. A low profile connector assembly in accordance with claim 1 wherein said housing includes at least one contact cavity configured to receive said wire engagement portion therein, said contact cavity opening to said wire receiving aperture.

13. A low profile connector assembly for mounting to a substrate, said connector assembly comprising:

first and second contacts, each of said first and second contacts having a surface mount portion mounted to a surface of the substrate, each surface mount portion being unitarily formed with a wire engagement portion; and a housing insertable over said first and second contacts and retained to at least one of said first and second contacts, said housing having an external bottom surface that engages the surface of the substrate when mounted to the first and second contacts, said housing enclosing said wire engagement portion and having a first wire receiving aperture providing access to a single one of said first and second contacts and a second wire receiving aperture providing access to the other of said first and second contacts, said first and second wire receiving apertures being cylindrical and configured to receive respective wires;

said wire engagement portions of said first and second contacts configured to engage and retain said wires, wherein said first and second contacts define a low profile dimension of about 10 mm or less measured perpendicularly to the substrate on which the surface mount portions are to be mounted.

14. A low profile connector assembly in accordance with claim 13 wherein said wire engagement portion of at least one of said contacts includes an insulation displacement contact section.

15. A low profile connector assembly in accordance with claim 13 wherein said first and second wire receiving apertures receive the respective wires prior to said housing being inserted over said first and second contacts such that the wires are configured to engage said first and second contacts as said housing is inserted over said first and second contacts.

16. A low profile connector assembly in accordance with claim 13 wherein said housing includes first and second contact cavities, said housing being securely retained to said first and second contacts by an interference lit between said first and second contacts and walls defining said first and second contact cavities.

17. A low profile connector assembly in accordance with claim 13 wherein said housing includes a single housing body.

18. A low profile connector assembly in accordance with claim 13 wherein said housing is provided only on one side of the substrate when mounted to the contacts.

19. A low profile connector assembly in accordance with claim 13 wherein said first and second contacts are separately provided from one another and configured to receive different ones of the wires.

* * * * *